US006808044B1

(12) United States Patent
Barbetta

(10) Patent No.: US 6,808,044 B1
(45) Date of Patent: Oct. 26, 2004

(54) LIGHTWEIGHT LOUDSPEAKER ENCLOSURE

(76) Inventor: Anthony T. Barbetta, 5345 Commerce Ave., Suite 5, Moorpark, CA (US) 93021

( * ) Notice: Subject to any disclaimer, the term of this patent is extended or adjusted under 35 U.S.C. 154(b) by 0 days.

(21) Appl. No.: 10/777,817

(22) Filed: Feb. 11, 2004

Related U.S. Application Data

(63) Continuation of application No. 10/447,482, filed on May 28, 2003, now Pat. No. 6,719,092, which is a continuation of application No. 09/921,991, filed on Aug. 2, 2001, now abandoned.

(60) Provisional application No. 60/223,053, filed on Aug. 4, 2000.

(51) Int. Cl.[7] ..... A47B 81/06; E04B 1/82; E04B 2/02; E04B 1/84

(52) U.S. Cl. ..... 181/199; 181/290; 181/294

(58) Field of Search ..... 181/199, 148, 181/160, 290, 294, 295, 286, 296

(56) References Cited

U.S. PATENT DOCUMENTS

| | | | | | |
|---|---|---|---|---|---|
| 3,539,425 | A | * | 11/1970 | Marburg | 156/247 |
| 3,804,195 | A | * | 4/1974 | Everitt et al. | 181/148 |
| 3,859,401 | A | * | 1/1975 | Gallap et al. | 264/45.3 |
| 4,109,983 | A | * | 8/1978 | Kinoshita | 312/7.1 |
| 4,284,168 | A | | 8/1981 | Gaus | 181/199 |
| 4,596,305 | A | | 6/1986 | Jagborn | 181/151 |
| 4,811,403 | A | | 3/1989 | Henricksen | 381/87 |
| 4,869,340 | A | * | 9/1989 | Coudoux | 181/146 |
| 5,218,176 | A | * | 6/1993 | Meyer, Jr. | 181/199 |
| 5,519,178 | A | | 5/1996 | Ritto et al. | 181/199 |
| 5,625,999 | A | * | 5/1997 | Buzza et al. | 52/793.11 |
| 5,916,405 | A | | 6/1999 | Ritto et al. | 156/245 |
| 6,206,999 | B1 | | 3/2001 | Ritto et al. | 156/245 |

* cited by examiner

*Primary Examiner*—David Martin
*Assistant Examiner*—Edgardo San Martin
(74) *Attorney, Agent, or Firm*—Sierra Patent Group, Ltd.

(57) ABSTRACT

A loudspeaker enclosure is disclosed. The loudspeaker enclosure comprises a base panel, a first side panel configured to attach to the base panel, a second side panel configured to attach to the base panel, a top panel configured to attach to the first side panel and the second side panel, a front panel configured to attach to the base panel, the first side panel, the second side panel, and the top panel, the front panel defining at least one loudspeaker opening configured to receive a loudspeaker, and a rear panel configured to attach to the base panel, the first side panel, the second side panel, and the top panel.

19 Claims, 3 Drawing Sheets

LIGHTWEIGHT LOUDSPEAKER ENCLOSURE

RELATED APPLICATIONS

This application is a continuation of U.S. Pat. application Ser. No. 10/447,482, filed May 28, 2003 now U.S. Pat. No. 6,719,092, which is a continuation of U.S. patent application Ser. No. 09/921,991, filed Aug. 2, 2001, now abandoned, which claims the benefit of U.S. Provisional Application Ser. No. 60/223,053 filed Aug. 4, 2000.

BACKGROUND

The present invention relates to improvements to loudspeaker enclosures. Specifically, the present invention relates to an improved lightweight loudspeaker enclosure and an improved method of manufacturing a lightweight loudspeaker enclosure.

Speaker enclosures of the prior art are typically made out of a rigid material and have a box-like shape. The rigid material is generally a dense material, such as plywood or particle board. The front side of the speaker enclosure includes a baffle that has several openings in which the diaphragm portion of the speaker is positioned so that sound can emanate out from the speaker enclosure. This describes the typical speaker enclosure that is used in many different applications including speakers for home use and speakers for use at music concerts.

One drawback that occurs in many large prior art speaker enclosures is that they are very heavy. In particular, the large speakers that are used, for example, in music concerts require large speaker enclosures. Generally, the enclosures have to be made out of fairly thick material to support the weight of the speakers. Consequently, the speaker enclosures can become very heavy. As can be appreciated, the heavier the speaker enclosure, the more difficult to move and support the speaker enclosure. In some instances, the increased weight results in difficulties in mounting these enclosures.

Yet another difficulty is faced by the manufacturer of loudspeaker enclosures. In order to manufacture lightweight speaker enclosures, manufacturers are often required to assemble a speaker cabinet in one piece out of lightweight materials. This can be time consuming and costly. It may also require the use of expensive assembly equipment.

To address these problems, some speaker enclosure designers have built enclosures for speakers out of materials that are lightweight and could, conceivably, absorb some errant sound waves. One example of such an enclosure is shown in U.S. Pat. No. 3,804,195, which discloses a loudspeaker enclosure made out of corrugated sheets of material. The corrugated sheets of material include hollow portions. Each of these sheets is joined to each other in a box-like configuration. Another example is U.S. Pat. No. 4,811,403, which discloses a lightweight loudspeaker enclosure that uses a rigid, lightweight honeycombed material in part of the speaker enclosure. While the weight characteristics and sound performance of the speaker enclosures disclosed above may be improved by the use of corrugated material, the enclosures disclosed in both these patents still have some surfaces which will vibrate in response to errant sound waves and thereby reduce the overall efficiency and sound performance of the speakers.

Another example is U.S. Pat. No. 6,206,999, which discloses a speaker enclosure having a substantially seamless rigid outer skin, a middle absorbing layer and a substantially seamless inner skin. The speaker enclosure is substantially seamless to dampen the transmission of errant sound waves. However, the speaker enclosure disclosed in U.S. Pat. No. 6,206,999 is fabricated by a mold process and thus involves a complex method of manufacturing.

Hence, there is a need in the art for a lightweight speaker enclosure that performs multiple functions. The speaker enclosure of the present invention serves as a rigid yet lightweight structure to support and orient the speaker drivers in position for suitable sound projection and it provides a defined air mass with which the speaker piston can interact to accomplish efficient transfer of low frequency energy. There is also a need for a method of manufacturing a lightweight speaker enclosure in which the speaker enclosure is constructed from lightweight panels and the individual panels are then easily assembled into the speaker enclosure.

SUMMARY

The present invention is a loudspeaker enclosure and a method of manufacturing a loudspeaker enclosure. The loudspeaker enclosure of the present invention is designed to serve as a structure to support and orient the speaker drivers in a position for suitable sound projection and it provides a defined air mass with which the speaker piston can interact to accomplish efficient transfer of low frequency energy.

In one aspect of the invention, a loudspeaker enclosure is provided which is easily and inexpensively manufactured with simple, commonly available materials and tools. The loudspeaker enclosure comprises a base panel, a first side panel configured to attach to the base panel, a second side panel configured to attach to the base panel, a top panel configured to attach to the first side panel and the second side panel, a front panel configured to attach to the base panel, the first side panel, the second side panel, and the top panel, the front panel defining at least one loudspeaker opening configured to receive a loudspeaker, and a rear panel configured to attach to the base panel, the first side panel, the second side panel, and the top panel.

In another aspect of the invention a method of manufacturing a loudspeaker enclosure is disclosed. The method comprises providing a base panel, attaching to the base panel a first side panel such that a first side panel first mounting feature interlocks with a first base mounting feature, attaching to the base panel a second side panel such that a second side panel first mounting feature interlocks with a second base mounting feature, providing a top panel configured to attach to the first side panel and the second side panel, attaching a front panel to the first base panel groove, to the first side panel first groove, and to the second side panel first groove such that the front panel has at least one loudspeaker opening configured to receive a loudspeaker, attaching a rear panel to the second base panel groove, to the first side panel second groove, and to the second side panel second groove, and attaching the top panel to the first side panel second mounting feature via the top panel first mounting feature, to the second side panel second mounting feature via the top panel second mounting feature, to the front panel via the top panel first groove, and to the rear panel via the top panel second groove.

BRIEF DESCRIPTION OF THE DRAWINGS

Referring now to the figures, wherein like elements are numbered alike.

DETAILED DESCRIPTION

Those of ordinary skill in the art will realize that the following description of the present invention is illustrative only and not in any way limiting. Other embodiments of the invention will readily suggest themselves to such skilled persons.

The specification and drawings of U.S. patent application Ser. No. 10/447,482, filed May 28, 2003 and U.S. patent application Ser. No. 09/921,991, filed Aug. 2, 2001, now abandoned, are hereby incorporated by reference.

Figure 1:
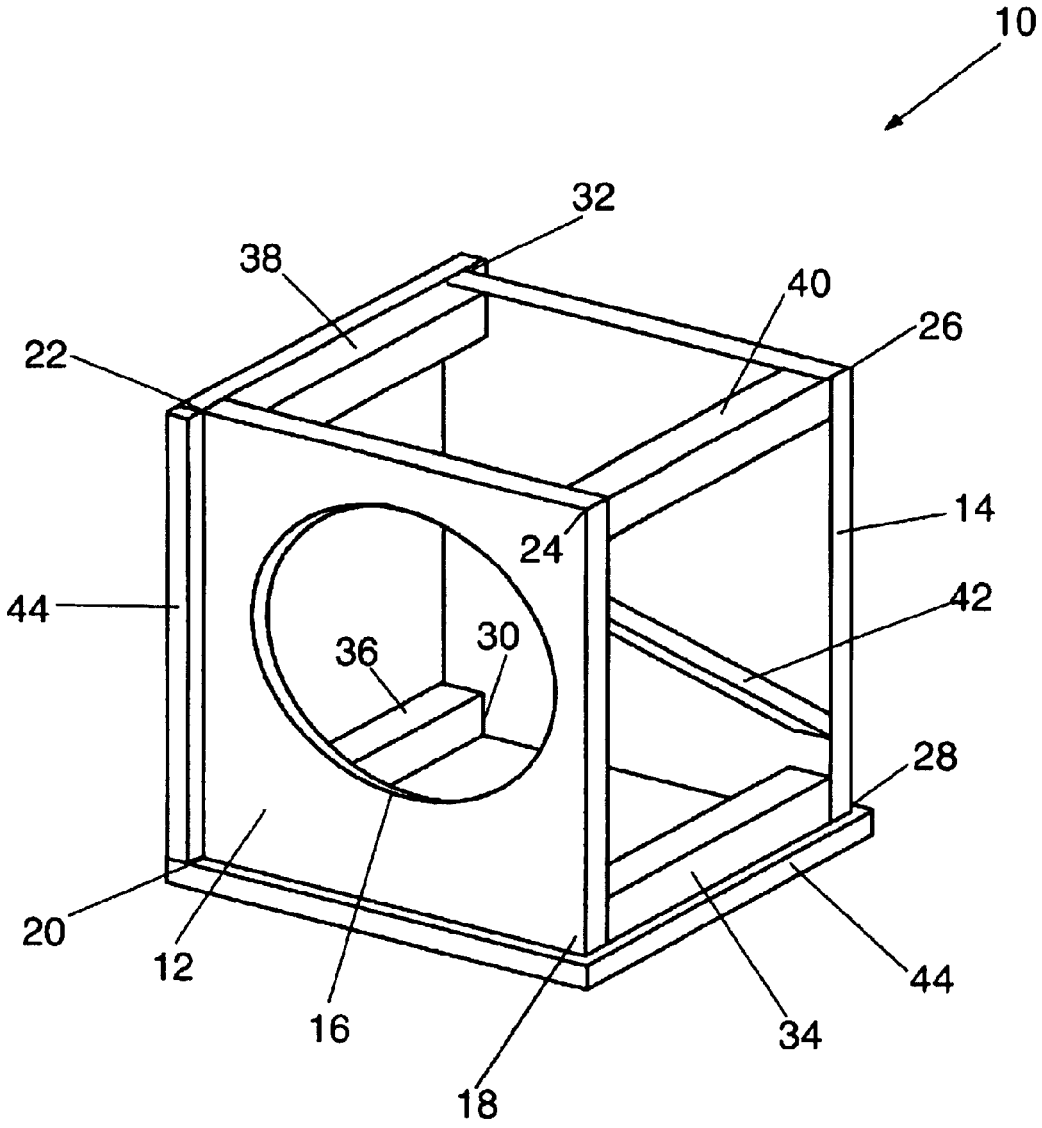
FIG. 1 illustrates an isometric view of an exemplary loudspeaker enclosure.

FIG. 1 discloses a loudspeaker enclosure 10 for home use and use at a variety of commercial, theatrical and musical events. Speaker enclosure 10 has a front panel 12 and a rear (or back) panel 14. Front panel 12 and rear panel 14 can be formed from a variety of materials, such as wood, plastic, or a lightweight alloy. In most instances, front panel 12 and rear panel 14 are made from any commonly used wood materials. Front panel 12 defines an opening 16 to accept the speakers. Because of opening 16, the front panel is lightweight even though it is made from solid material. Rear panel 14 is a solid piece of material. However, in another embodiment, rear panel 14 can be structured as foam laminate panel 44, as described below, and is, therefore, lightweight.

Front panel 12 has four corners (or junction points) 18, 20, 22 and 24. Rear panel 14 has four corners (or junction points) 26, 28, 30 and 32. In order to form the speaker enclosure, a bottom (or base) panel, a top (or surface) panel, and two opposing side panels (all not shown in FIG. 1) are also attached to the speaker enclosure to complete the enclosure.

In one embodiment, as illustrated in FIG. 1, the corners 18, 20, 22 and 24 of front panel 12 are connected to the corners 26, 28, 30 and 32 of rear panel 14 by structural members 34, 36, 38 and 40. Corner 18 of front panel 12 is attached to corner 28 of rear panel 14 by structural member 34. Corner 20 of front panel 12 is attached to corner 30 of rear panel 14 by structural member 36. Corner 22 of front panel 12 is attached to corner 32 of rear panel 14 by structural member 38. Finally, corner 24 of front panel 12 is attached to corner 26 of rear panel 14 by structural member 40.

Referring still to FIG. 1, an additional structural member 42 also connects front panel 12 to rear panel 14. Additional structural member 42 can also be utilized to provide additional support. Additional structural member 42 is a structural member that is attached at an angle to the edges of front panel 12 and rear panel 14 dividing the frame between the two panels into two triangular spaces. Although not shown, additional structural members can connect front panel 12 and rear panel 14 at the top of the speaker enclosure, at the bottom of the speaker enclosure and on the opposing side of the speaker enclosure.

The structural members discussed above can be made from rigid struts. These rigid struts are constructed from a lightweight wood material. As set forth below, rigid struts may also function for layer 50 between front panel 12 and rear panel 14.

Front panel 12 and rear panel 14 when connected by structural members 34, 36, 38 and 40 and also connected by triangulated structural members, illustrated by triangulated structural member 42, forms a triangulated structure or frame, which is enclosed by lightweight foam laminate panels 44.

Figure 2:
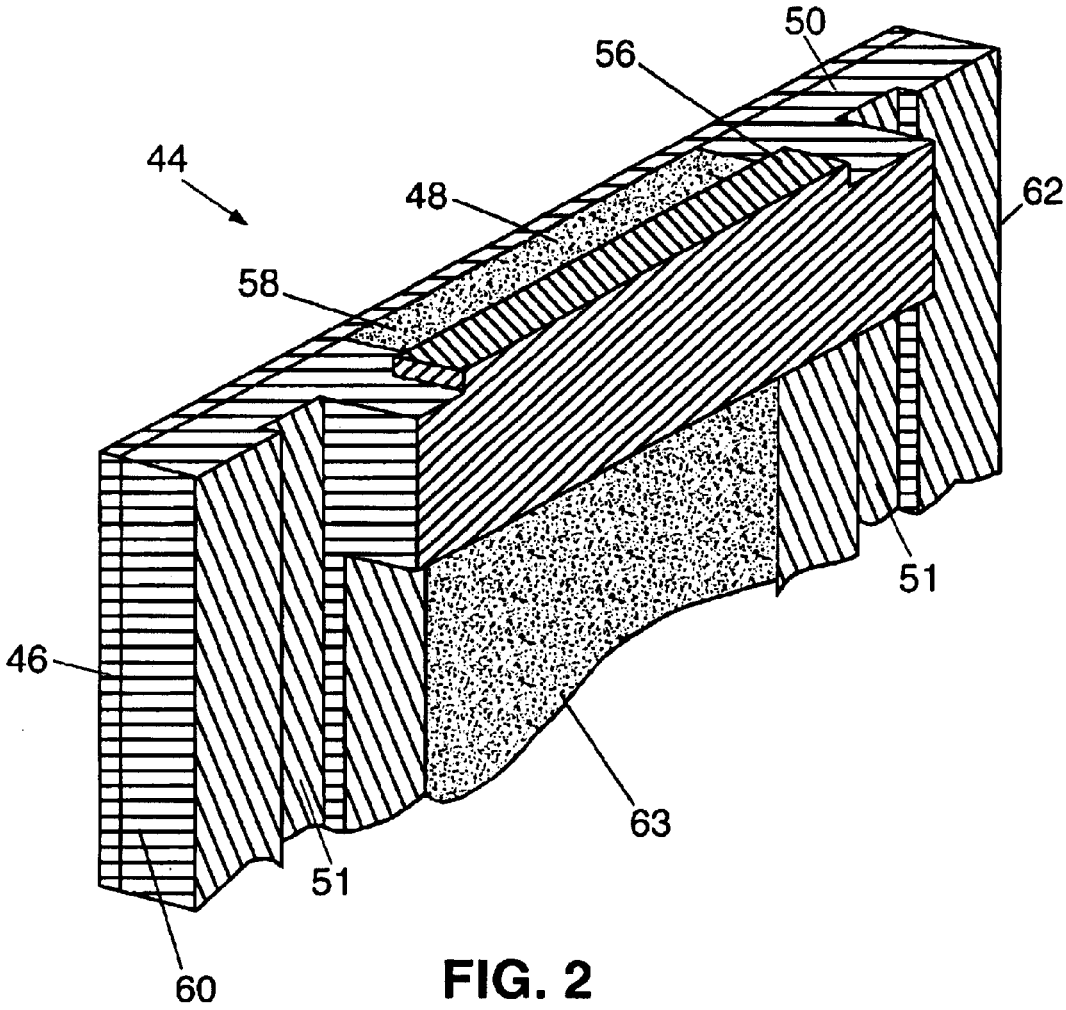
FIG. 2 illustrates an elevated perspective view of an exemplary panel.
Figure 3A:
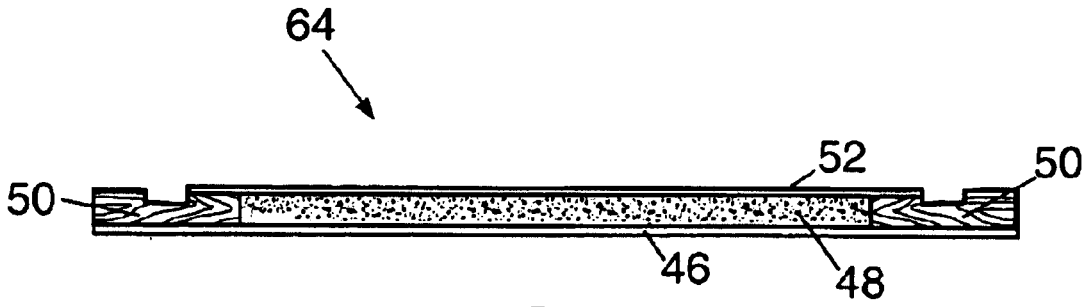
FIG. 3A illustrates a side view of one embodiment of an exemplary loudspeaker enclosure.

FIGS. 2 and 3A disclose another embodiment for constructing the speaker enclosure. In FIGS. 2, 3A, 3B, and 3C, the panels are constructed of a foam laminate material, as illustrated by panel 44. The top panel, bottom panel and opposing side panels are all constructed in the same manner. Foam laminate panel 44 is indicative of the structure of each of the panels. Foam laminate panel 44 has a rigid outer layer 46, foam layer 48 and rigid inner layer 52. Foam layer 48 is sandwiched between rigid outer layer 46, layer 50 and rigid inner layer 52. Rigid outer layer 46 is comprised of a lightweight skin material such as thin plywood, wood composition material, pressboard, plastic or fiberglass sheet or any other suitable material. Preferably, the rigid outer layer 46 can be formed form about 1 to about 3 millimeter plywood, about 1 to 3 millimeters wood composition material, about 1 to 3 millimeters pressboard, about 1 to about 3 millimeters plastic, and about 1 to 3 millimeters fiberglass. Rigid outer layer 46 has outer side and an inner side.

The top panel, bottom panel and opposing side panels are each constructed in order to allow for easy assembling of the speaker enclosure. In one embodiment, layer 50 is attached to the inner side of outer layer 46. Layer 50 may be milled wooden strips having grooves (or slots or mounting features) 51 for forming dado joints. Foam layer 48 is disposed on the inner side of rigid outer layer 46 between layer 50 and inner layer 52. Foam layer 48 can be made from commercially available material, for example polystyrene foam or any other suitable pre-laminated foam material or material, such as a honeycomb kraft material manufactured by Hexacomb or Fome-Cor manufactured by International Paper Co.

In another embodiment, as illustrated in FIG. 2, each of the opposing side panels 44 are constructed with two extended mounting features (or tongues or male inserts or male members) 56 extending toward the bottom side and top side 58 of the side panels. The opposing side panels are also constructed with grooves 51 on the sides 60, 62 of front face 63 of the side panel 44.

Figure 3B:
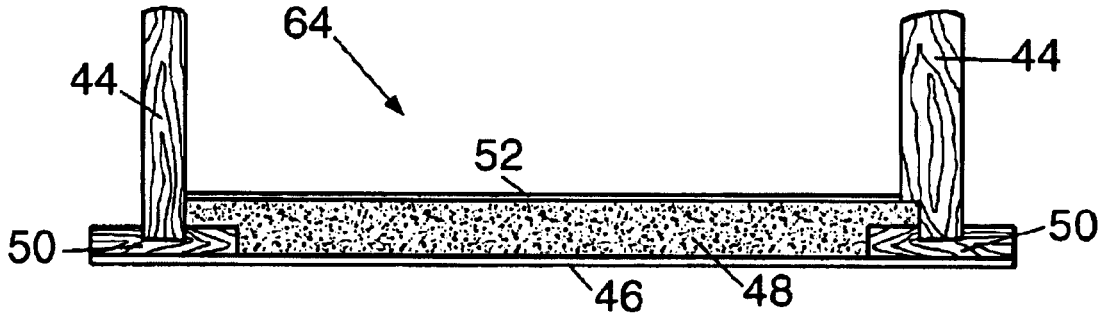
FIG. 3B illustrates a side view of another embodiment of an exemplary loudspeaker enclosure.
Figure 3C:
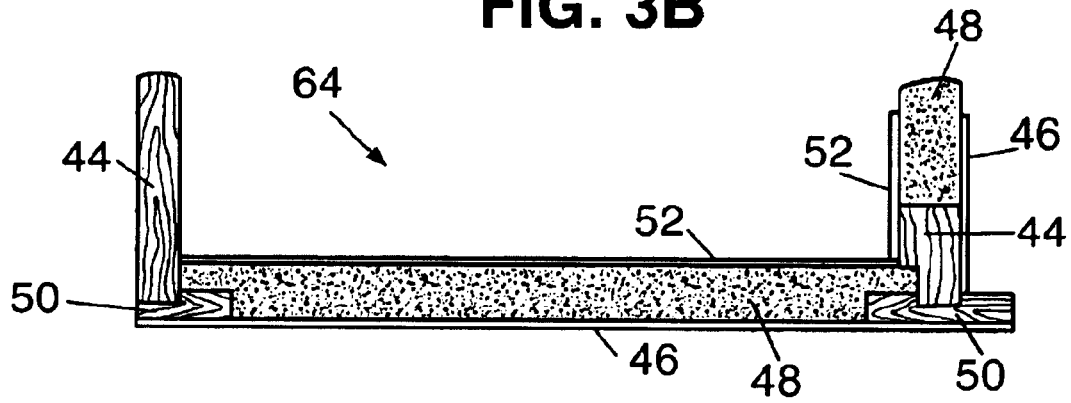
FIG. 3C illustrates a side view of yet another embodiment of an exemplary loudspeaker enclosure.

As illustrated in FIGS. 3A, 3B, and 3C, the top and bottom panels are configured with grooves on the sides of the front face of the top and bottom panels. The top and bottom panels are also configured with two female receiving members (or female grooves) for lining up with the side panels and receiving the male inserts.

FIG. 3A illustrates a side view of either top or bottom panel 64. Rigid inner layer 52 is adhered to foam layer 48 and layer 50 to form panel 64. Rigid inner layer 52 is a lightweight skin layer comprised of a lightweight skin material such as thin plywood, wood composition material, pressboard, plastic or fiberglass sheet or any other suitable material. Preferably, the rigid inner layer 52 can be formed form about 1 to about 3 millimeter plywood, about 1 to 3 millimeters wood composition material, about 1 to 3 millimeters pressboard, about 1 to about 3 millimeters plastic, and about 1 to 3 millimeters fiberglass. FIG. 3A illustrates a side view of the top of panel 64 showing a top view of the grooves 51 for the insertion of either the front panel 12 or back panel 14. Panel 64 is then adhered to the side panels to form speaker enclosure 10.

FIG. 3B illustrates another embodiment of speaker enclosure 10. In this embodiment, foam laminate panel 64 has rigid outer layer 46 and foam layer 48. Rigid inner layer 52 is adhered directly to the panel 64. FIG. 3B also illustrates a side view of the top of panel 64 showing a top view of the grooves 51 for the insertion of the side panels 44. As described above, panel 64 has two female receiving structures for receiving the male counterpart of the side panels. When constructing the speaker enclosure, no fasteners are utilized, except for small brads, which may be used to hold the panels in correct orientation while the assembly adhesive cures. Preferably, the panels are glued into place with an adhesive, such as carpenters glue, acrylic, and the like as suitable for use with the materials from which the enclosure panels are constructed. Many commonly available types of products used in construction or home maintenance can be utilized in the interlocking design of the speaker enclosure.

FIG. 3C illustrates yet another embodiment of speaker enclosure 10. As set forth above, side panel 44 is constructed of a foam laminate. Foam laminate panel 64 comprises rigid outer layer 46, foam layer 48 and rigid inner layer 52. In this embodiment, panel 44 is directly adhered to the panel 64, with the male member of panel 44 fitting snuggly into the female member of panel 64. The rigid inner layers 52 of both panels are adhered to each other.

In yet another embodiment, a cosmetic laminate may be applied to the outer side of the outer surface for cosmetic purposes.

The following presents one embodiment of constructing the speaker enclosure. The method or procedure for manufacture of speaker enclosure 10 begins with providing front panel 12 and rear panel 14. Front panel 12 and rear panel 14 can be formed from a variety of materials. In most instances, front panel 12 and rear panel 14 are made from any commonly used wood materials. Front panel 12 defines an opening 16 to accept the loudspeakers. Because of opening 16, the front panel is lightweight even though it is made from solid material. Rear panel 14 can be a solid piece of material or other suitable material, or it can be of a foam laminate design as described herein.

Front panel 12 has four corners 18, 20, 22 and 24. Rear panel 14 has four corners 26, 28, 30 and 32. Next, the corners 18, 20, 22 and 24 of front panel 12 are connected to the corners 26, 28, 30 and 32 of rear panel 14 by structural members 34, 36, 38 and 40. Corner 18 of front panel 12 is attached to corner 28 of rear panel 14 by structural member 34. Corner 20 of front panel 12 is attached to corner 30 of rear panel 14 by structural member 36. Corner 22 of front panel 12 is attached to corner 32 of rear panel 14 by structural member 38. Finally, corner 24 of front panel 12 is attached to corner 26 of rear panel 14 by structural member 40.

Additional structural member 42 connects front panel 12 to rear panel 14. Additional structural member 42 is a structural member that is attached at an angle to the front panel 12 and rear panel 14 dividing the area between front panel 12 and rear panel 14 into two triangular spaces. Although not shown, additional structural members connect front panel 12 and rear panel 14 at the top of the speaker enclosure, at the bottom of the speaker enclosure and on the opposing side of the speaker enclosure. These additional structural members are not shown for clarity.

Next, when front panel 12 and rear panel 14 are connected by structural members 34, 36, 38 and 40 and also connected by additional structural members, illustrated by additional structural member 42, they form a triangulated structure or frame, which is enclosed by lightweight foam laminate panels 44. Next layer 50 is provided. Layer 50 is attached to the inner side of outer layer 46. Finally, the side panels, the top panel and the bottom panel are attached.

The following presents another embodiment of constructing the speaker enclosure. The male members of the side panels are interlocked into the female receiving members of the bottom panel. Next, the front and rear panels are disposed into the grooves of the side panels and the bottom panel until the front and rear panels fit snuggly into the grooves of the bottom panel. Lastly, the top panel is positioned such that the female receiving members fit snuggly with the male members of the side panels and that the front and rear panels fit snuggly in the grooves of the top panel.

While embodiments and application of this invention have been shown and described, it would be apparent to those skilled in the art that more modifications that mentioned above are possible without departing from the inventive concepts herein. The invention, therefore, is not to be restricted except in the spirit of the appended claims.

What is claimed is:

1. A loudspeaker enclosure comprising:

a base panel having a front surface and a back surface opposite thereof and a first side and a second side forming a base perimeter, said base panel having a first base mounting feature and a second base mounting feature opposite thereof and proximate said base perimeter, said base panel having a first groove and a second groove opposite thereof and proximate said base perimeter, wherein said base panel is defined by a set of contiguous layers, said plurality of contiguous layers including a first base layer, a second base layer, and a third base layer consecutively layered, wherein said first base layer is selected from the group consisting of plywood, wood composition material, pressboard, plastic, and fiberglass, wherein said second base layer, is selected from the group consisting of a foam material and an expanded polystyrene, and wherein said third base layer is selected from the group consisting of plywood, wood composition material, pressboard, plastic, and fiberglass;

a first side panel configured to attach to said base panel, said first side panel having a front surface and a back surface opposite thereof and a first side and a second side forming a first side panel perimeter, said first side panel having a first side panel first mounting feature and a first side panel second mounting feature opposite thereof and proximate said first side panel perimeter, said first side panel having a first side panel first groove and a first side panel second groove opposite thereof and proximate said first side panel perimeter, wherein said first side panel is defined by a plurality of contiguous layers, said plurality of contiguous layers including a first side panel layer, a second side panel layer, and a third side panel layer consecutively layered, wherein said first panel layer is selected from the group consisting of plywood, wood composition material, pressboard, plastic, and fiberglass, wherein said second side panel layer is selected from the group consisting of a foam material and an expanded polystyrene, and wherein said third side panel layer is selected from the group consisting of plywood, wood composition material, pressboard, plastic, and fiberglass;

a second side panel configured to attach to said base panel, said second side panel having a front surface and a back surface opposite thereof and a first side and a second side forming a second side panel perimeter, said second side panel having a second side panel first mounting feature and a second side panel second mounting feature opposite thereof and proximate said second side panel perimeter, said second side panel having a second side panel first groove and a second side panel second groove opposite thereof and proximate said second side panel perimeter, wherein said second side panel is defined by a plurality of contiguous layers, said plurality of contiguous layers including a fourth side panel layer, a fifth side panel layer, and a sixth side panel layer consecutively layered, wherein said fourth side panel layer is selected from the group consisting of plywood, wood composition material, pressboard, plastic, and fiberglass, wherein said fifth side panel layer is selected from the group consisting of a foam material and an expanded polystyrene, and wherein said sixth side panel layer is selected from the group consisting of plywood, wood composition material, pressboard, plastic, and fiberglass;

a top panel configured to attach to said first side panel and said second side panel, said top having a front surface and a back surface opposite thereof and a first side and a second side forming a top panel perimeter, said top panel having a top panel first mounting feature and a top panel second mounting feature opposite thereof and proximate said top panel perimeter, said top panel having a top panel first groove and a top panel second groove opposite thereof and proximate said top panel perimeter, wherein said top panel is defined by a plurality of contiguous layers, said plurality of contiguous layers including a first top layer, a second top layer, and a third top layer consecutively layered, wherein said first top layer is selected from the group consisting of plywood, wood composition material, pressboard, plastic, and fiberglass, wherein said second top layer is selected from the group consisting of a foam material and an expanded polystyrene, and wherein said third top layer is selected from the group consisting of plywood, wood composition material, pressboard, plastic, and fiberglass;

a front panel having a front surface and a back surface opposite thereof, said front panel configured to attach to said base panel, said first side panel, said second side panel, and said top panel, said front panel defining at least one loudspeaker opening configured to receive a loudspeaker; and a rear panel having a front surface and a back surface opposite thereof, said rear panel configured to attach to said base panel, said first side panel, said second side panel, and said top panel.

2. The loudspeaker enclosure of claim 1, wherein said base panel first mounting feature, said base panel second mounting feature, said top panel first mounting feature, and said top panel second mounting feature are female receiving members.

3. The loudspeaker enclosure of claim 2, wherein said first side panel first mounting feature, said first side panel second mounting feature, said second side panel first mounting feature, and said second side panel second mounting feature are configured to mountably insert into said female receiving members.

4. The loudspeaker enclosure of claim 1, wherein dado joints are formed when said first side panel attaches to said base panel and to said top panel.

5. The loudspeaker enclosure of claim 1, wherein dado joints are formed when said second side panel attaches to said base panel and to said top panel.

6. The loudspeaker enclosure of claim 1, wherein an adhesive is utilized to join said base panel, said first side panel, said second side panel, said top panel, said front panel and said rear panel to form said loudspeaker enclosure.

7. The loudspeaker enclosure of claim 1, wherein said first base layer, said first side panel layer, said fourth side panel layer, and said first top layer are selected from the group consisting of about 1 to about 3 millimeters plywood, about 1 to about 3 millimeters wood composition material, about 1 to about 3 millimeters pressboard, about 1 to about 3 millimeters plastic, and about 1 to about 3 millimeters fiberglass.

8. The loudspeaker enclosure of claim 1, wherein said second base layer, said second side panel layer, said fifth side panel layer, and said second top layer are selected from the group consisting of a foam material and an expanded polystyrene.

9. The loudspeaker enclosure of claim 1, wherein said third base layer, said third side panel layer, said sixth side panel layer, and said third top layer are selected from the group consisting of about 1 to about 3 millimeters plywood, about 1 to about 3 millimeters wood composition material, about 1 to about 3 millimeters pressboard, about 1 to 3 millimeters plastic, and about 1 to about 3 millimeters fiberglass.

10. The loudspeaker enclosure of claim 1, wherein said rear panel is defined by a plurality of contiguous layers.

11. A method of manufacturing a loudspeaker enclosure comprising:

providing a base panel having a front surface and a back surface opposite thereof and a first side and a second side forming a base perimeter, said base panel having a first base mounting feature and a second base mounting feature opposite thereof and proximate said base perimeter, said base panel having a first groove and a second groove opposite thereof and proximate said base perimeter, wherein said base panel is defined by a set of contiguous layers, said plurality of contiguous layers including a first base layer, a second base layer, and a third base layer consecutively layered, wherein said first base layer is selected from the group consisting of plywood, wood composition material, pressboard, plastic, and fiberglass, wherein said second base layer, is selected from the group consisting of a foam material and an expanded polystyrene, and wherein said third base layer is selected from the group consisting of plywood, wood composition material, pressboard, plastic, and fiberglass;

attaching to said base panel a first side panel having a front surface and a back surface opposite thereof and a first side and a second side forming a first side panel perimeter, said first side panel having a first side panel mounting feature and a first side panel second mounting feature opposite thereof and proximate said first side panel perimeter, said first side panel having a first side panel first groove and a first side panel second groove opposite thereof and proximate said first side panel perimeter, said first side panel first mounting feature interlocks with said first base mounting feature, wherein said first side panel is defined by a plurality of contiguous layers, said plurality of contiguous layers including a first side panel layer, a second side panel layer, and a third side panel layer consecutively layered, wherein said first panel layer is selected from the group consisting of plywood, wood composition material, pressboard, plastic, and fiberglass, wherein said second side panel layer is selected from the group consisting of a foam material and an expanded polystyrene, wherein said third side panel layer is selected from the group consisting of plywood, wood composition material, pressboard, plastic, and fiberglass;

attaching to said base panel a second side panel, said second side panel having a front surface and a back surface opposite thereof and a first side and a second side forming a first side panel perimeter, said second side panel having a second side panel first mounting feature and a second side panel second mounting feature opposite thereof and proximate said second side panel perimeter, said second side panel having a second side panel first groove and a second side panel second groove opposite thereof and proximate said second side panel perimeter, said second side panel first mounting feature interlocks with said second base mounting feature, wherein said second side panel is defined by a plurality of contiguous layers, said plurality of contiguous layers including a fourth side panel layer, a fifth side panel layer, and a sixth side panel layer consecutively layered, wherein said fourth side panel layer is selected from the group consisting of plywood, wood composition material, pressboard, plastic, and fiberglass, wherein said fifth side panel layer is selected from the group consisting of a foam material and an expanded polystyrene, and wherein said sixth side panel layer is selected from the group consisting of plywood, wood composition material, pressboard, plastic, and fiberglass;

providing a top panel configured to attach to said first side panel and said second side panel, said top having a front surface and a back surface opposite thereof and a first side and a second side forming a top panel perimeter, said top panel having a top panel first mounting feature and a top panel second mounting feature opposite thereof and proximate said top panel perimeter, said top having a top panel first groove and a top panel second groove opposite thereof and proximate said top panel perimeter, wherein said top panel is defined by a plurality of contiguous layers, said plurality of contiguous layers including a first top layer, a second top layer, and a third top layer consecutively layered, wherein said first top layer is selected from the group consisting of plywood, wood composition material, pressboard, plastic, and fiberglass, wherein said second top layer is selected from the group consisting of a foam material and an expanded polystyrene, and wherein said third top layer is selected from the group consisting of plywood, wood composition material, pressboard, plastic, and fiberglass;

attaching a front panel having a front surface and a back surface opposite thereof to said first base panel groove, to said first side panel first groove, and to said second side panel first groove, said front panel defining at least one loudspeaker opening configured to receive a loudspeaker;

attaching a rear panel having a front surface and a back surface opposite thereof to said second base panel groove, to said first side panel second groove, and to said second side panel second groove; and attaching said top panel to said first side panel second mounting feature via said top panel first mounting feature, to said second side panel second mounting feature via said top panel second mounting feature, to said front panel via said top panel first groove, and to said rear panel via said top panel second groove, said attaching said top panel defines an interior and an exterior of the loudspeaker enclosure.

12. The method of claim 11, wherein said base panel first mounting feature, said base panel second mounting feature, said top panel first mounting feature, and said top panel second mounting feature are female receiving members.

13. The method of claim 12, wherein said first side panel first mounting feature, said first side panel second mounting feature, said second side panel first mounting feature, and said second side panel second mounting feature configured to mountably insert into said female receiving members.

14. The method of claim 11, wherein dado joints are formed when said first side panel attaches to said base panel and to said top panel.

15. The method of claim 11, wherein dado joints are formed when said second side panel attaches to said base panel and to said top panel.

16. The method of claim 11, further comprising:

applying an adhesive to join said base panel, said first side panel, said second side panel, said top panel, said front panel, and said rear panel for forming said loudspeaker enclosure.

17. The method of claim 11, wherein said first base layer, said first side panel layer, said fourth side panel layer, and said first top layer are selected from the group consisting of about 1 to about 3 millimeters plywood, about 1 to about 3 millimeters wood composition material, about 1 to about 3 millimeters pressboard, about 1 to about 3 millimeters plastic, and about 1 to about 3 millimeters fiberglass.

18. The method of claim 11, wherein said second base layer, said second side panel layer, said fifth side panel layer, and said second top layer are selected from the group consisting of a foam material and an expanded polystyrene.

19. The method of claim 11, wherein said third base layer, said third side panel layer, said sixth side panel layer, and said third top layer are selected from the group consisting of about 1 to about 3 millimeters plywood, about 1 to about 3 millimeters wood composition material, about 1 to about 3 millimeters pressboard, about 1 to 3 millimeters plastic, and about 1 to about 3 millimeters fiberglass.

* * * * *